US005375806A

United States Patent [19]

Debus et al.

[11] Patent Number: 5,375,806

[45] Date of Patent: Dec. 27, 1994

[54] BOOK HOLDER

[75] Inventors: Larry L. Debus, 335 E. Palm La., Phoenix, Ariz. 85004; Ernest C. Garcia, Phoenix; Robert G. Loos, Scottsdale, both of Ariz.

[73] Assignee: Larry L. Debus, Phoenix, Ariz.

[21] Appl. No.: 662,407

[22] Filed: Feb. 28, 1991

[51] Int. Cl.[5] ..... A47B 97/04

[52] U.S. Cl. ..... 248/452; 248/444.1

[58] Field of Search ..... 248/451–453, 248/444.1

[56] References Cited

U.S. PATENT DOCUMENTS

| | | | |
|---|---|---|---|
| 290,381 | 12/1883 | Wood | 248/452 |
| 634,781 | 10/1899 | Veilex | 248/452 |
| 1,226,452 | 5/1917 | Bolton | 248/451 |
| 2,609,636 | 9/1952 | Stone | 248/453 |
| 4,512,603 | 4/1985 | Williams | 248/451 X |
| 4,702,453 | 10/1987 | Bishop | 248/452 X |
| 4,877,213 | 10/1989 | Lambert | 248/451 |
| 4,907,777 | 3/1990 | Stewart | 248/453 |

FOREIGN PATENT DOCUMENTS

| | | | |
|---|---|---|---|
| 2260968 | 10/1975 | France | 248/451 |
| 557656 | 1/1975 | Switzerland | 248/452 |
| 411839 | 9/1974 | U.S.S.R. | 248/452 |

*Primary Examiner*—Alvin C. Chin-Shue

*Attorney, Agent, or Firm*—Cahill, Sutton & Thomas

[57] ABSTRACT

The holder includes a back plate with tabs thereon for capturing the front and back covers of an open book. Hingedly mounted on an upper region of the back plate are a pair of page holders which are spring-biased into contact with the exposed left and right hand pages, respectively, of the open book. The page holders are made of transparent material and have smooth surfaces in contact with the book pages so that the latter are easily slid beneath the holders. The right hand edge of the page contacting surface of the left hand holder is beveled to permit a page to be easily slid beneath that holder as it is turned.

3 Claims, 1 Drawing Sheet

BOOK HOLDER

TECHNICAL FIELD

This invention is concerned with reliably holding a book in open position for reading while permitting the pages to be turned with a minimum of effort from the reader.

BACKGROUND ART

There have been many devices proposed for supporting a book in an open position so that it may be read while the hands of the reader are free to perform some other task.

A very simple holder is disclosed in U.S. Pat. No. 3,833,197, granted Sept. 3, 1974, to B. Dyke for "Book Holder". With this holder, the pages of the book are only loosely confined between back plates and fences which are spaced a fixed distance apart. The result is that the few pages at the beginning and end of thee book are hardly confined at all. Free movement of these pages can interfere with their being read.

An improved page holding arrangement is incorporated into an Adjustable Reading Material Stand disclosed in U.S. Pat. No. 3,952,989, granted Apr. 27, 1976, to C. L. B. Hatcher. This stand employs spring-biased fingers pressing against the pages to keep them open. A disadvantage of the arrangement disclosed is that these fingers must be lifted from the surface of the pages as the latter are turned. This is a two-hand manipulation and the reader may not always have both hands free to turn the page.

The page turning problem is addressed in a holder disclosed in U.S. Pat. No. 4,407,523, granted Oct. 4, 1983, to A. P. Campione for "Book Holder". This inventor contends that a flat plate extending across the lower face of the left and right hand pages and held against the pages by rubber bands can be pulled forward to free a page by the fingers of one hand while other fingers of the same hand turn the page. The maneuver would appear to require considerable skill and dexterity on the part of the reader; these traits may not be possessed by some readers.

There continues to be a need for a book holder for reliably retaining a book in an open position, regardless of the attitude in which the book is held and which simplifies one-hand page turning.

DISCLOSURE OF THE INVENTION

The holder of this invention has a back plate with tabs thereon for capturing the front and back covers of an open book. Hingedly mounted on an upper region of the back plate are a pair of page holders which are spring-biased into contact with the exposed left and right hand pages, respectively, of the open book. The holders are made of transparent material and have smooth surfaces in contact with the book pages so that the pages are easily slid beneath the holders. In addition, the right hand edge of the page contacting surface of the left hand holder is beveled to permit a page to be easily slid therebeneath as it is turned.

BRIEF DESCRIPTION OF THE DRAWINGS

The invention is described in greater detail hereinafter by reference to the accompanying drawings, wherein.

BEST MODE FOR CARRYING OUT THE INVENTION

Figures 1, 2, 3, 4, 5:
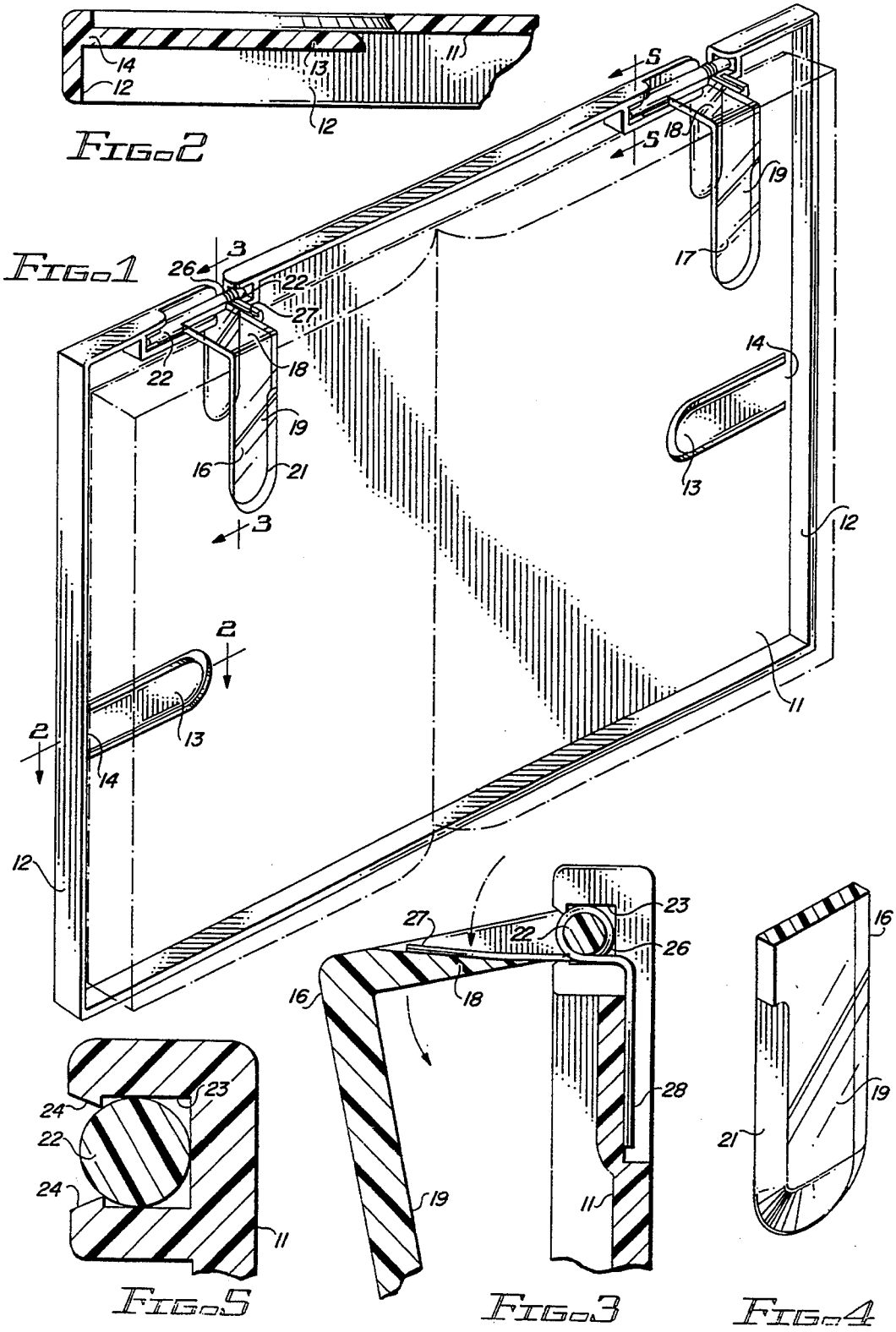
FIG. 1 is a perspective view of the book holder of this invention.
FIG. 2 is an enlarged sectional view through a cover-retaining tab taken as indicated by line 2—2 in FIG. 1.
FIG. 3 is an enlarged, fragmentary, sectional view through a left hand page holder taken as indicated by line 3—3 in FIG. 1.
FIG. 4 is a fragmentary view of the page contacting surface of the left hand page holder.
FIG. 5 is an enlarged sectional view of a page holder hinge taken as indicated by line 5—5 in FIG. 1.

Referring particularly to FIG. 1, the numeral 11 designates a back plate which is one of the principal components of the book holder of this invention. Back plate 11 is adapted to receive in flush, face-to-face engagement therewith, the outer faces of the front and back covers of an open book. The book is shown in phantom in FIG. 1. The back plate 11 may, if desired, be provided with an upstanding peripheral rim 12 extending around at least the bottom and side edges of the plate. Rim 12 serves the purpose of positioning the book on the back plate.

The book holder of this invention can be made larger or smaller to accommodate books of different sizes. However, inasmuch as the invention is believed to have particular usefulness in the reading of paperback books, if the back plate has a height of approximately seven inches and a width of approximately nine inches, most books of that type will be accommodated.

In accordance with the invention, the back plate 11 has a pair of retaining tabs 13 carried at opposite side regions for capturing the front and back covers of the book. If the back plate is formed of injected molded plastic, and this is the preferred construction, the tabs 13 can be formed integral with the remainder of the back plate 11. With simple coring of the back plate molds the tabs 13 can be offset from the plane of the back plate 11 in the manner shown in FIG. 2 to permit the book covers to be easily slid between the tabs 13 and the surrounding regions of the back plate. Stated differently, the tabs capture the book covers by sliding between the covers and adjacent pages of the book, leaving the pages free to be turned as the book is read.

If the back plate 11 and tabs 13 therein are molded from a semi-rigid plastic material, such as acrylonitrile butadiene styrene (ABS), there will be some resilient flexibility along the line of attachment 14 between the tabs 13 and the back plate 11 so that the tabs can move slightly to receive and then tightly grip the book covers.

The pages of the open book are held open in an essentially flat condition by a pair of page holders 16 and 17 which are hingedly attached to back plate 11 along an upper region thereof. Page holders 16 and 17 are preferably L-shaped with the short leg 18 attached to the back plate 11 and spacing a longer tongue leg 19 from the back plate and over the pages of the book.

The tongue legs 19 of page holders 16 and 17 are fairly wide, say, in excess of one-half inch, and the back surfaces thereof, i.e., the surfaces contacting the book pages, are hard and smooth so that it is possible to manually slide a page beneath the holders even though they are biased into contact with the pages. In addition, the back page contacting surface of left hand page holder 16 is beveled around its right hand and bottom edges as indicated at 21 (see FIG. 4). This bevel 21 facilitates sliding a page under the left hand page holder 16 after it has been freed from the right hand page holder 17 and "turned". This maneuver is easily performed with one hand of the reader who grasps and slides a page from beneath right hand holder 17, flips the page over and slides it beneath the left hand holder 16.

The two page holders 16 and 17 may be identical and may even be produced in the same mold. They are made from a hard, clear plastic material, such as polycarbonate. That material is crystal-clear so the print beneath each holder 16 and 17 can be easily read through the holder.

One preferred arrangement for hingedly mounting the page holders 16 and 17 on the back plate 11 is illustrated i FIGS. 1, 3, and 5. The distal end of each short leg 18 of each holder has transverse trunnions 22 molded thereon for positioning within receptacles 23 provided in the upper region of back plate 11. Small protuberances 24 at the mouth of each receptacle retain the trunnions 22 in the receptacles after the trunnions have been snapped into place.

A helical spring 26 surrounding one trunnion 22 of each page holder 16 and 17 has end extensions 27 and 28 bearing, respectively, on the short leg 18 of the holder and the back of back plate 11, biasing the holder into contact with the book pages (see FIG. 3). The forces exerted by springs 26 are light, being just sufficient to cause the holders 16 and 17 to keep the pages of the book flat. The holders 16 and 17 are easily lifted to permit a book to be inserted in the holder.

From the foregoing, it should be apparent that the book holder of this invention provides for reliably retaining a book in open position for hands-free reading and which permits the pages of the book to be turned easily using one hand.

What is claimed is:

1. A book holder comprising a back plate against which the front and back covers of an open book rest, said back plate having a top region and opposite side regions, retainer tabs on the opposite side regions of said back plate and adapted to overlie, respectively, the front and back cover of the book between those covers and adjacent pages of the book, left and right page holders adapted to overlie upper regions of the exposed left and right pages, respectively, of a book on said back plate, said page holders being made of transparent material and being hingedly attached to the top region of said back plate, said page holders having broad, smooth surfaces contacting said pages to permit the pages to be manually slid beneath the page holders, and spring means biasing said page holders into contact with the exposed pages of the book with sufficient force to hold the pages flat while permitting the pages to be easily slid beneath the page holders, said left page holder having a beveled right edge on the face thereof which contacts the pages of the book to facilitate sliding a page beneath that holder when the page is turned.

2. The book holder of claim 1, further characterized in that said page holders are substantially L-shaped with one leg hingedly attached to said back plate and the other leg overlying a page of the book.

3. The book holder of claim 1, further characterized in that said back plate has an upstanding perimeter rim thereon to assist in positioning a book on the back plate.

* * * * *